US005586581A

United States Patent [19]

Suwa

[11] Patent Number: 5,586,581

[45] Date of Patent: Dec. 24, 1996

[54] CLOTH ROLL DRIVING APPARATUS FOR DRIVING THE CLOTH ROLL AT TWO DIFFERENT SPEEDS

[75] Inventor: Mitsuru Suwa, Kanazawa, Japan

[73] Assignee: Tsudakoma Kogyo Kabushiki Kaisha, Ishikawa, Japan

[21] Appl. No.: 569,519

[22] Filed: Dec. 8, 1995

[30] Foreign Application Priority Data

Dec. 22, 1994 [JP] Japan ..... 6-336247

[51] Int. Cl.[6] ..... D03D 49/20

[52] U.S. Cl. ..... 139/304; 192/48.9; 139/309

[58] Field of Search ..... 74/665 GE; 192/48.1, 192/56.1, 48.9; 139/309, 310, 304

[56] References Cited

U.S. PATENT DOCUMENTS

| | | | |
|---|---|---|---|
| 2,243,482 | 5/1941 | Meyer | 192/48.9 |
| 3,620,262 | 11/1971 | Atkinson | 139/310 |
| 3,710,829 | 1/1973 | Johnson et al. | 139/304 |
| 5,507,198 | 4/1996 | Yang | 192/48.9 |

FOREIGN PATENT DOCUMENTS

| | | |
|---|---|---|
| 0296113 | 12/1988 | European Pat. Off. . |
| 1000684 | 3/1989 | European Pat. Off. . |
| 5-35742 | 2/1993 | Japan . |
| 5-25742 | 2/1993 | Japan . |

*Primary Examiner*—Andy Falik

*Attorney, Agent, or Firm*—Frishauf, Holtz, Goodman, Langer & Chick

[57] ABSTRACT

A cloth roll driving apparatus is provided adjacent to the main shaft of a weaving machine. The apparatus comprises a drive source driven in synchronism with the main shaft of the weaving machine, a slave shaft coupled to a cloth roll and a one-way clutch. Further, there are provided a first power transmission mechanism which transmits, through the one-way clutch, the rotation of the drive shaft to the slave shaft as a torque in the cloth take-up direction and at a velocity corresponding to the weaving velocity of the cloth, and a clutch mechanism which is coupled to the slave shaft while the cloth is wound around the cloth roll when the cloth roll is empty. Moreover, there is also provided a second power transmission mechanism which transmits, through the clutch mechanism, the rotation of the drive shaft to the slave shaft as a torque in the same direction as the torque transmitted by the first power transmission mechanism and at a velocity higher than the latter torque.

7 Claims, 3 Drawing Sheets

CLOTH ROLL DRIVING APPARATUS FOR DRIVING THE CLOTH ROLL AT TWO DIFFERENT SPEEDS

BACKGROUND OF THE INVENTION

1. Field of the Invention

The present invention relates to a cloth roll driving apparatus for winding a cloth fed from a weaving machine around a cloth roll.

2. Description Of The Prior Art

As disclosed in Japanese Laid-Open Patent Publication H5-25742, it has been usual that a cloth fed from a weaving machine is wound around a cloth roll and after the cloth has been fully wound around the cloth roll, the full cloth roll is replaced with a cloth roll having no cloth wound thereround (hereinafter called an empty cloth roll). In this case, in order to allow the top end of the cloth to be wound securely around the empty cloth roll, the empty cloth roll is rotated faster than usual by means of a motor for allowing the cloth to be taken up by the empty cloth roll thereby preventing the cloth from being wound around the empty cloth roll in a state in which the top end of the cloth is loosened with respect to the roll. The empty cloth roll driving motor is provided separately from the weaving machine driving motor and the two motors are coupled to the cloth roll rotating shaft through gear mechanisms, respectively. The gear mechanisms are arranged such that a one-way clutch mechanism is interposed between the gear mechanisms and the gear mechanisms can slip relative to each other with respect to their rotation in a predetermined direction.

Consequently, the empty cloth roll mounted at the cloth take-up position is rotated faster than usual so that the top end of the cloth is securely wound around the empty cloth roll. In this case, the rotation effected by the weaving machine driving motor is transmitted to the cloth roll shaft but the rotational velocity difference between the two gear mechanisms is absorbed by the one-way clutch and the gear mechanisms are not influenced by each other. Then, when the end of the cloth is wound around the empty cloth roll, the motor for rotating this roll ceases to rotate and due to the torque from the weaving machine driving motor, the cloth roll is rotated slower than when the cloth is wound around the empty cloth roll. In this case, the rotation of the gear mechanism coupled to the empty cloth roll driving motor is interrupted by the one-way clutch arranged therebetween so that no torque is transmitted to the stopped empty roll driving motor.

However, the above-described conventional cloth roll driving apparatus has had the disadvantages that the apparatus requires a device for driving an empty cloth roll to replace a full cloth roll in addition to an apparatus for driving a cloth take-up roll so that the overall structure of the cloth roll driving apparatus becomes complicated and large-sized resulting in an increase in the manufacturing cost.

SUMMARY OF THE INVENTION

The present invention has been made in view of the above-described conventional technological problems and an object of the present invention is to provide a cloth roll driving mechanism which is simple in structure and which is capable of winding the end of the cloth around an empty cloth roll securely at the time of replacing a full cloth roll.

The cloth roll driving apparatus according to the present invention comprises a drive source driven in synchronism with the main shaft of a weaving machine, a driveshaft coupled to the drive source, a slave shaft, a first power transmission mechanism provided with a one-way clutch and adapted to transmit, through the one-way clutch, the rotation of the drive shaft to the slave shaft as a torque in the winding direction of a cloth and at a velocity corresponding to the weaving velocity of the cloth, and a second power transmission mechanism provided with a clutch mechanism which is coupled to the slave shaft during the time of winding the cloth around an empty cloth roll, and adapted to transmit, through the clutch mechanism, the rotation of the drive shaft to the slave shaft as a torque in the same direction as the torque transmitted by the first power transmission mechanism and at a velocity higher than the velocity of that torque.

Further, the present invention features that the clutch mechanism included in the second power transmission mechanism is a torque limiter having a torque so determined that it is larger than the torque for rotating the empty cloth roll and smaller than the cloth take-up torque after the completion of winding the cloth around the empty cloth roll. Moreover, the clutch mechanism included in the second power transmission mechanism is an electromagnetic clutch which connects the drive shaft and the slave shaft when the cloth roll is empty and which separates the two shafts when the cloth is being taken up by the cloth roll after the cloth has been wound around the roll.

The cloth roll driving apparatus of the present invention is adapted to transmit the driving force utilized for driving the cloth roll to the first and second power transmission mechanisms. It operates such that when the cloth is taken up, the rotation of the drive shaft is transmitted to the slave shaft by the first power transmission mechanism through the one-way clutch and the clutch mechanism of the second power transmission mechanism is disconnected so that the rotation transmittable from the second power transmission mechanism is not directed to the slave shaft. Further, when the end of the cloth is wound around an empty cloth roll, the rotation from the second power transmission mechanism is transmitted to the slave shaft to allow the latter to be rotated faster than as usual and no relative rotation is transmitted from the slave shaft to the drive shaft through the first power transmission mechanism due to the operation of the one-way clutch.

DETAILED DESCRIPTION OF THE PREFERRED EMBODIMENTS

Figure 1:
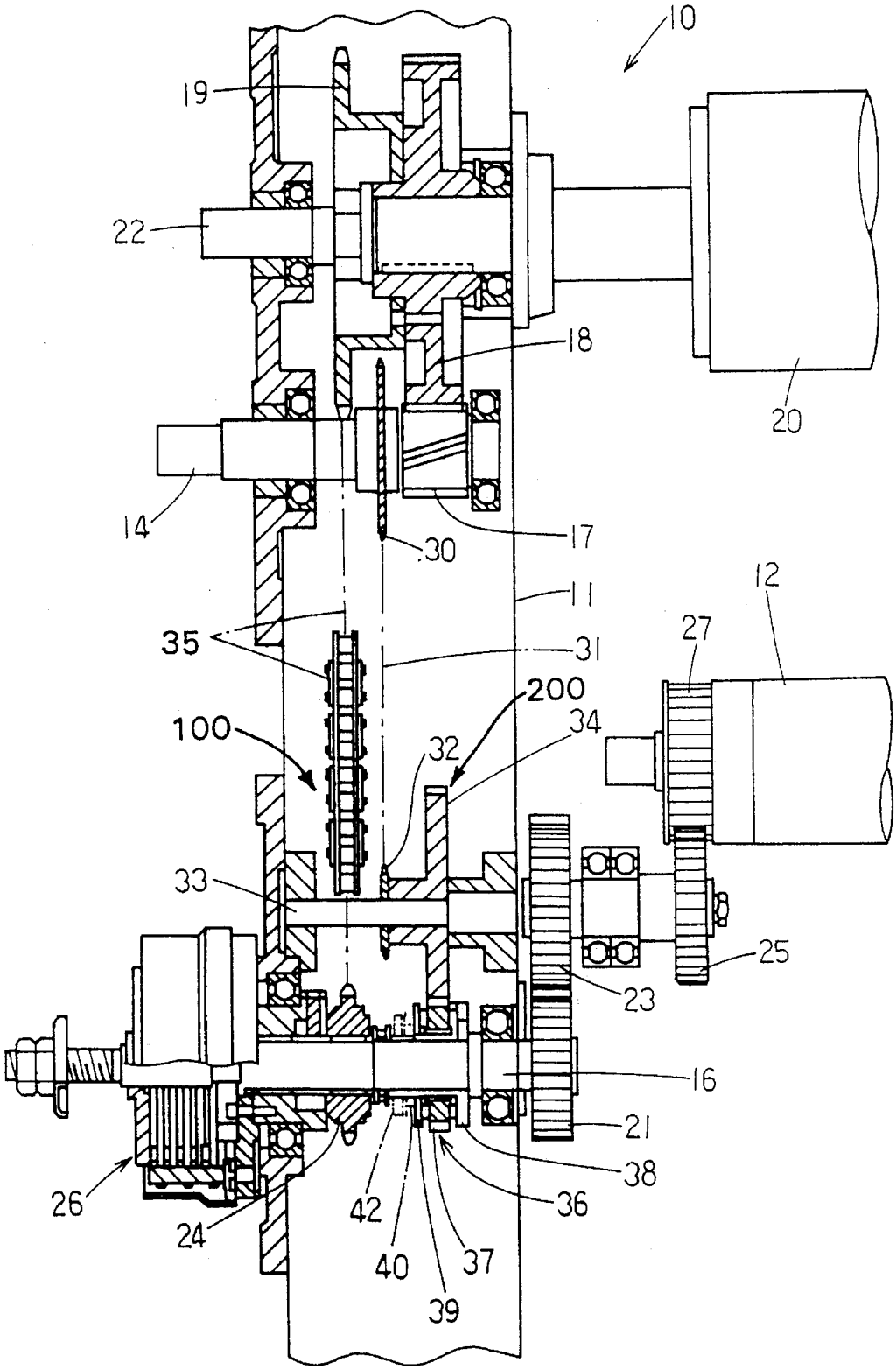
FIG. 1 is a vertical sectional view of a cloth roll driving mechanism according to one embodiment of the present invention.
Figure 2:
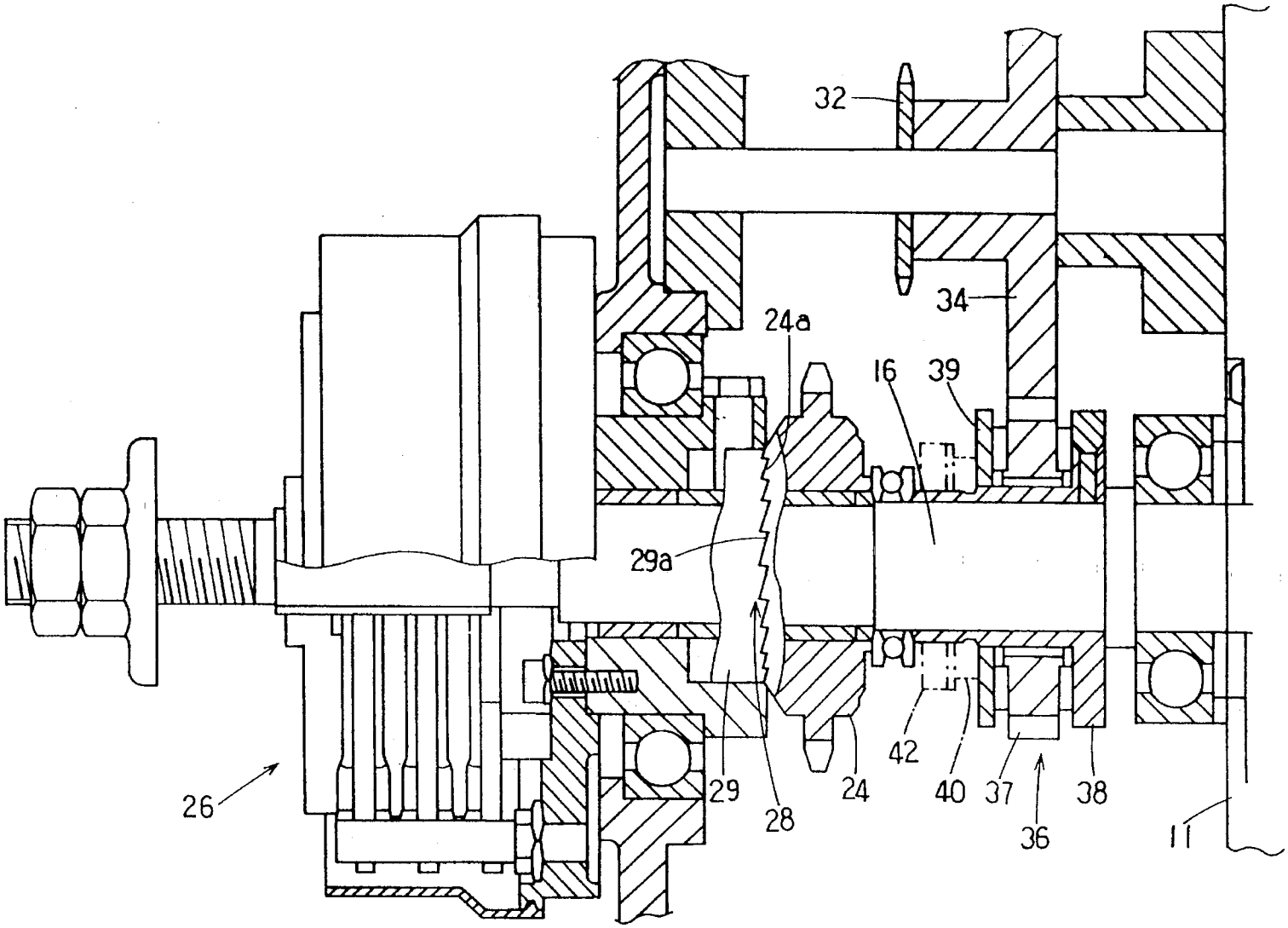
FIG. 2 is an enlarged sectional view of a slave shaft of the cloth roll driving apparatus shown in FIG. 1.

One embodiment of the present invention will be described with reference to the accompanying drawings wherein FIGS. 1 and 2 show this embodiment. As shown, the cloth roll driving apparatus 10 is adapted to wind a predetermined amount of cloth woven by a weaving machine (not shown) around a cloth roll 12. The cloth roll driving apparatus 10 is arranged within a side frame 11 of the weaving machine and is provided with a drive shaft 14 driven by the main shaft of the weaving machine and a slave shaft 16 driven by the drive shaft 14. Between the drive shaft 14 and the slave shaft 16 there are arranged a first power transmission mechanism 100 and a second power transmission mechanism 200 for transmitting the driving force of the drive shaft 14 to the slave shaft 16. Further, at one end of the slave shaft 16 there is fixed a gear 21 with which a gear 23 meshes. Further, a gear 25 which is integral and coaxial with the gear 23 meshes with a gear 27 which is integral with the cloth roll 12. Accordingly, the cloth roll 12 is coupled to the slave shaft 16 via the gears 21, 23, 25 and 27 and the rotation of the slave shaft 16 is transmitted to the cloth roll 12 through these gears. The cloth roll 12 is detachable with respect to the weaving machine and when the cloth roil 12 is replaced, it is disconnected from the slave shaft 16 by separating the gear 25 from the gear 27.

The first power transmission mechanism is provided with a gear 17 fixed coaxially with the drive shaft 14, a gear 18 fixed to a rotary shaft 22 of a surface roll 20 so as to mesh with the gear 17 and a sprocket 19 coaxially fixed to the rotary shaft 22. Further, the first power transmission mechanism has a free wheel 24 having sprocket-like teeth and coaxial with the slave shaft 16, and is provided with a chain 35 for connecting the sprocket 19 and the free wheel 24. The free wheel 24 and the slave shaft 16 are coupled together so as to coaxially rotate relative to each other through a torque limiter 26 and boss 29 coaxial with the slave shaft 16. Further, the boss 29 contacts the free wheel 24, the free wheel 24 is connected with a one-way clutch mechanism 28 and the torque limiter 26 and the boss 29 are coaxially fixed. The one-way clutch mechanism 28 comprises a serrated portion **29*a* of the boss 29 and a like portion 24*a* of the free wheel 24 meshing with the former enabling only unidirectional rotation transmission. That is, it is capable of transmitting the rotation of the free wheel 24 in a predetermined direction relative to the slave shaft 16 and the predetermined direction in this case is the rotational direction of the slave shaft 16 for rotating the cloth roll 12** in a direction in which the cloth is taken up.

Similarly, the second power transmission mechanism is adapted to rotate the slave shaft 16 faster than the first power transmission mechanism and it comprises a sprocket 30 coaxially fixed to the drive shaft 14, a chain 31 meshing with the sprocket 30, a sprocket 32 driven by the chain 31, a rotary shaft 33 to which the sprocket 32 is coaxially fixed and a gear 34 coaxially fixed to the rotary shaft 33. The gear 34 meshes with a gear 37 forming a torque limiter 36 as a clutch mechanism coaxial with the slave shaft 16.

The torque limiter 36 has clutch plates 38 and 39 arranged on both sides of the gear 37, respectively, and the clutch plate 38 is fixed to the slave shaft 16. The clutch plate 39 can not rotate relative to the clutch plate 38 and is made movable slightly in the longitudinal direction of the slave shaft 16. Further, clutch plate 39 is urged toward the gear 37 by means of a spring 40 so as to be brought into pressure contact with the gear 37. The spring 40 is compressed to give rise to a predetermined spring force by means of a pressure regulating screw 42 screw-fitted into the boss of the clutch plate 38.

The torque limiter 36 of the second power transmission mechanism can transmit only a torque in a preset range and this set torque is larger than the torque for rotating the empty cloth roll 12 but is smaller than the take-up torque after the completion of winding a cloth around the empty cloth roll 12. The torque for rotating the empty cloth roll 12 also includes a slip torque generating by the one-way clutch mechanism 28.

The cloth roll driving apparatus 10 according to the instant embodiment makes use of the driving force of the main shaft for winding a cloth and at the same time, the driving force is transmitted to the first and second power transmission mechanisms. Thus, when the cloth is taken up, the driving force is transmitted to the free wheel 24 by the chain 35 through the gears 17 and 18 and the sprocket 19 as the first power transmission mechanism coupled to the drive shaft 14. Then a torque is transmitted to the boss 29 from the free wheel 24 through the torque limiter 26. This torque is transmitted to the slave shaft 16 through the torque limiter 26 and finally, the torque is transmitted from the slave shaft 16 to the cloth roll 12 through the gears 21, 23, 25 and 27.

In this case, the torque is also transmitted to the torque limiter 36 through the sprocket 30, the chain 31, the sprocket 32 and the gear 34 forming the second driving power transmission mechanism and the gear 37 of the torque limiter 36 is rotated so as to rotate the slave shaft 16 faster than the first driving power transmission mechanism. However,as the maximum transmittable torque between the gear 37 of the torque limiter 36 and the clutch plate 39 is set to a sufficiently small value, a slip takes place between the clutch plate 39 and the gear 37 and the rotation of the gear 37 is not transmitted to the slave shaft 16. Accordingly, the winding of the cloth during the normal operation of the cloth roll driving apparatus is performed such that the rotation of the second driving power transmission mechanism is interrupted by the torque limiter 36 and the cloth is wound around the cloth roll 12 with a predetermined winding torque until the cloth roll 12 is fully wound with the cloth.

When the cloth roll 12 is in a fully wound state, it is transferred to a temporary storage table or a cart. Then, an empty cloth roll 12 is mounted at a predetermined take-up position and the gear 27 of the cloth roll 12 is caused to mesh with the gear 25 coupled to the slave shaft 16. After that, the cloth is cut with a cutter (not shown) and the end of the cut cloth on the side of the weaving machine is wound around the empty cloth roll 12.

In this case, a motor capable of generating a feedback pulse signal is used for driving the cloth cutter at the time of replacing the cloth roll such that the pulse signal is detected by a control device (not shown) and the moving amount of the cutter is controlled. Thus, the moving amount of the cutter is detected on the basis of the feedback pulse signal and if no such pulse signal is detected for a predetermined period of time, it is judged that the cutter is clogged with the cloth. If such cloth clogging is detected, the cutter is moved back once and after correcting the condition of the cloth with respect to the cutter, the cutter is again moved forward. In this connection, where the moving amount of the cutter is controlled by operating a stepping motor with a driving signal pulse as has conventionally been done, the clogging of cloth can not be detected but with the above-described structure of the present invention, it is possible to detect it by the presence of the feedback pulse from the cutter driving motor. Especially, when an automatic cloth roll exchanging operation is performed, it is possible to prevent securely the occurrence of a state in which the cloth roll can not be replaced for a long time.

When one end of the cloth is wound around the cloth roll 12, since the cloth roll is empty, almost no load torque is applied on the slave shaft 16 so that the slave shaft is easily rotated due to a torque transmittable from the torque limiter 36. That is, due to the static frictional force of the clutch plate 39 urged by the spring 40, the rotation of the gear 37 is transmitted to the clutch plate 39 so that the slave shaft 16 begins to rotate with the clutch plate 39. Accordingly, it is possible to rotate the slave shaft 16 faster than at the time of taking up the cloth and to wind the cloth around the cloth roll 12 securely with a predetermined tensile force without loosening the end of the cloth. Further, in the above case, the rotation of the free wheel 24 is transmitted to the boss 29 of the first power transmission mechanism. Therefore, the free wheel 24 will be rotating in the direction reverse to the direction of rotation of the boss 29 (the slave shaft 16). As a result, a slip takes place between the boss 29 and the free wheel 24 due to the action of the one-way clutch 28 and so the rotation of the slave shaft 16 is not transmitted to the drive shaft through the first power transmission mechanism.

The cloth roll driving apparatus in the instant embodiment makes use of the torque limiter 36 such that the number of rotations of the slave shaft 16 is automatically varied between the cloth take-up time in which a large load is applied on the cloth roll 12 by the cloth and the cloth end winding time (i.e. the cloth roll exchange time) in which only a small amount of load is applied on the roll, through the first and second power transmission mechanisms thereby securing the winding of the end of the cloth around the cloth roll without loosening the cloth. Furthermore, the switching between the transmitting powers of the first and second power transmission mechanisms is performed by making use of the variation of torque applied on the slave shaft 16 from on the side of the cloth roll 12, so that no electrical control mechanism is required and the switching is performed accurately by the apparatus which is simple in structure.

Figure 3:
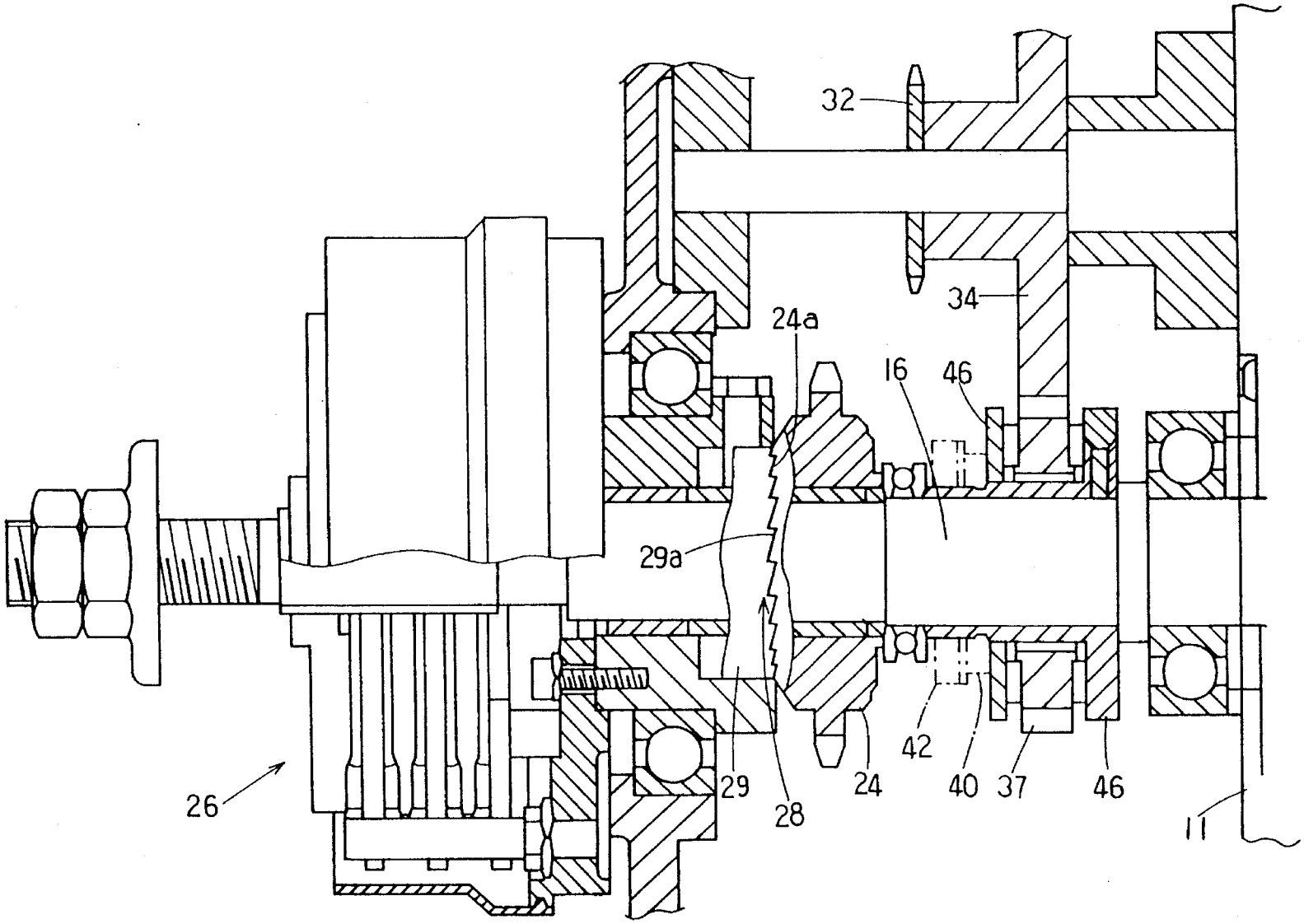
FIG. 3 is an enlarged sectional view of a slave shaft of the cloth roll driving apparatus according to another embodiment of the present invention.

Next, referring to FIG. 3 a second embodiment of the present invention will be described. The cloth roll driving apparatus according to this embodiment makes use of an electromagnetic clutch 46 instead of the torque limiter 36 of the first embodiment. In this case, the electromagnetic clutch 46 has to be turned ON or OFF by a control signal and such ON/OFF operations are performed after detecting the starting and completion of winding a cloth around an empty cloth roll 12. One method of such detection is such that the variation of the tensile force of the cloth resulting from the cutting of the cloth at the time of replacement of the cloth roll 12 is detected and magnetic clutch ON/OFF signals are outputted depending on whether or not the cloth is in a state of tension with the top end of the cloth wound around the cloth roll 12. Thus, if the cloth is not strained, the electromagnetic clutch 46 is turned ON and the slave shaft 16 is rotated at a higher velocity through the second power transmission mechanism.

Further, as another method of detection, the rotational velocity of the cloth roll 12 may be detected. That is, the velocity at which the cloth roll 12 is rotated through the first transmission mechanism is set to a value higher than the rotational velocity of the cloth roll 12 in a state in which the cloth is actually wound around the roll. This is intended to apply a suitable degree of tensile force on the cloth during the winding of the cloth around the cloth roll 12 and this is because the rotational velocity of the cloth roll 12 is reduced so that a desired tensile force is applied on the roll by means of the torque limiter 36. Accordingly, in the stage in which the cloth is cut by the cutter at the time of replacement of the cloth roll, the back-tension to be applied on the cloth roll 12 becomes zero and the cloth roll rotates at a velocity higher than when it rotates during weaving. Therefore, the electromagnetic clutch may be turned ON or OFF in the same manner by detecting the above state. Moreover, it goes without saying that the electromagnetic clutch may be turned ON or OFF manually in lieu of the above-mentioned electrical control.

It should be noted that the cloth roll driving apparatus of the present invention is not limited to the above-described embodiments and therefore, the positions of the one-way clutch and the clutch mechanism may be provided in any of the first and second power transmission mechanisms. Further, the drive shaft of the apparatus of the present invention may be driven by any means other than the main shaft of a weaving machine only if it makes use of a drive source for winding a cloth. Moreover, although in the above embodiments the first and second power transmission mechanisms have been described to have the shown structures, they are not always limited to such structures. That is, these mechanisms may have any other structures only if they include a one-way clutch and the clutch mechanisms of the present invention. It also goes without saying that the one-way clutch mechanism is not limited to that which is included in the above-described embodiments.

In the case of the cloth roll driving apparatus of the present invention, the drive source for allowing one end of a cloth to be wound around an empty roll is made to serve as a cloth roll drive source at the time of cloth take-up so that the cloth end winding mechanism is simplified and the entire structure of the apparatus is also simplified thereby reducing the manufacturing cost. Especially, by the use of a torque limiter as a clutch mechanism, the accurate switching between the rotational drive mechanisms for the slave shaft is made possible without performing an electrical control.

What is claimed is:

1. A cloth roll driving apparatus for taking up a cloth around a cloth roll, which comprises:

a drive source adapted to be driven in synchronism with a main shaft of a weaving machine;

a slave shaft coupled to a cloth roll;

a drive shaft coupled to the drive source;

a first power transmission mechanism provided with a one-way clutch and adapted to transmit, through the one-way clutch, rotation of the drive shaft to the slave shaft as a torque in a direction in which the cloth is taken up and at a velocity corresponding to the weaving velocity of the cloth; and a second power transmission mechanism provided with a clutch mechanism which is coupled to the slave shaft during the time of winding of the cloth around the cloth roll when the cloth roll is empty and adapted to transmit, through the clutch mechanism of the second power transmission mechanism, the rotation of the drive shaft as a torque in the same direction as the torque transmitted to the slave shaft by the first power transmission mechanism and at a velocity higher than said velocity corresponding to the weaving velocity of the cloth.

2. A cloth roll driving apparatus according to claim 1, wherein said first power transmission mechanism is provided with a gear mechanism to which said one-way clutch is coupled.

3. A cloth roll driving apparatus according to claim 1, wherein said second power transmission mechanism is provided with a gear mechanism to which said clutch mechanism is coupled.

4. A cloth roll driving apparatus according to claim 1, wherein said clutch mechanism includes a torque limiter having a torque that is larger than a torque for rotating the empty cloth roll and smaller than a take-up torque after completion of winding of the cloth around said empty cloth roll.

5. A cloth roll driving apparatus according to claim 4, wherein said first power transmission mechanism is provided with a gear mechanism to which said one-way clutch is coupled, and said second power transmission mechanism is provided with a gear mechanism to which said clutch mechanism is coupled.

6. A cloth roll driving apparatus according to claim 1, wherein the clutch mechanism of said second power transmission mechanism includes an electromagnetic clutch which connects said drive shaft and said slave shaft when said cloth roll is empty and which separates said drive shaft from said slave shaft in a state in which said cloth is taken up after said cloth has been wound around said cloth roll.

7. A cloth roll driving apparatus according to claim 6, wherein said first power transmission mechanism is provided with a gear mechanism to which said one-way clutch is coupled, and said second power transmission mechanism is provided with a gear mechanism to which said clutch mechanism is coupled.

* * * * *